United States Patent [19]

Egan et al.

[11] Patent Number: 4,759,144

[45] Date of Patent: Jul. 26, 1988

[54] AMBIDEXTROUS MAGAZINE RELEASE

[76] Inventors: James W. Egan, 14810 Lincoln St., SE., Minerva, Ohio 44657; Thomas A. Blackburn, 306 Plain St., Malvern, Ohio 44644

[21] Appl. No.: 69,844

[22] Filed: Jul. 6, 1987

[51] Int. Cl.[4] ..... F41C 27/00

[52] U.S. Cl. ..... 42/7

[58] Field of Search ..... 42/7

[56] References Cited

U.S. PATENT DOCUMENTS

| | | | |
|---|---|---|---|
| 4,521,985 | 6/1985 | Smith et al. | 42/7 |
| 4,615,134 | 10/1986 | Beretta | 42/7 |
| 4,713,902 | 12/1987 | Wigton | 42/7 |

*Primary Examiner*—Charles T. Jordan

*Attorney, Agent, or Firm*—Oldham, Oldham & Weber Co.

[57] ABSTRACT

An ambidextrous release for gun magazines for semi automatic pistols such as Colt, government Model "Colt", and other semi automatic pistols. The new release is built into conventional gun magazine release structures and it only requires a catch lock release lever which is positioned externally of the gun butt or grip on the right side thereof as one holds the pistol operatively. Such lock release lever has a free end normally positioned spaced from the gun butt, the lever being operatively carried by the control extension on the catch body of the magazine release by means of a slot formed in such extension and pivotally positioning one end of the catch lock release lever therein, a fulcrum member operatatively positioned on such catch lock release lever bears on an outer end of the catch lock release member so that when the free end the catch lock release lever is forced inwardly towards the gun butt, the opposite end of such lever moves the entire magazine catch body towards the right to release the magazine by action of the conventional lock members engaging the same, but whereby the release action is readily obtained from the right hand side of the pistol structure.

4 Claims, 2 Drawing Sheets

AMBIDEXTROUS MAGAZINE RELEASE

TECHNICAL FIELD

This invention relates in general to gun magazine release structures, and more particularly to an ambidextrous magazine release for pistols, especially semi-automatic pistols.

BACKGROUND OF THE INVENTION

Magazine release structures for semi-automatic pistols such as the Colt government model "45" pistol normally have a push button activated catch lock release that is operated from the left side of the pistol. Hence, for the right handed shooter, it would generally be activated with one of his thumbs; and, in so doing, the shooter's grip on the butt of the gun is usually released or partially relaxes during magazine release for a clip change. Such action results in a loss of time and/or it also may adversely affect the shooting accuracy. If a new, improved ambidextrous magazine release could be provided, this would enable one to have one-handed operation of the pistol, or at least to simplify the magazine release so that it could be done readily from either the right or left side of the gun butt. One prior ambidextrous gun magazine release is shown in U.S. Pat. No. 4,521,985 but such structure has not gone into widespread use. The prior types of ambidextrous gun releases are thought to be relatively costly and involve several structural changes in the pistol and the release structure provided therein.

It also should be understood that, if the speed of the magazine change can be enhanced, the speed of the shooter should then improve and possible accuracy can also be improved, resulting in better shooting scores.

It is the general object of the present invention to provide a new and improved ambidextrous gun magazine release which is readily operated from the right hand side of a pistol butt by the index finger of the shooter.

Another object of the invention is to make a minimum number of modifications of the gun magazine release structure of a standard pistol and to provide a sturdy but improved ambidextrous magazine release for a semi-automatic pistol.

Yet another object of the invention is to provide an improved magazine release operable from the right side of the butt of a standard type pistol, wherein an external operating lever is pivotally connected to the magazine catch body and is fulcrumed on the lock release pin to provide axial release movement of the catch body when desired.

BRIEF DESCRIPTION OF THE DRAWINGS

Reference now is made to the accompanying drawings, wherein.

When referring to corresponding members shown in the drawing and referred to in the specification, corresponding numerals are used to facilitate comparison therebetween.

BEST MODE FOR CARRYING OUT THE INVENTION

Figure 1:
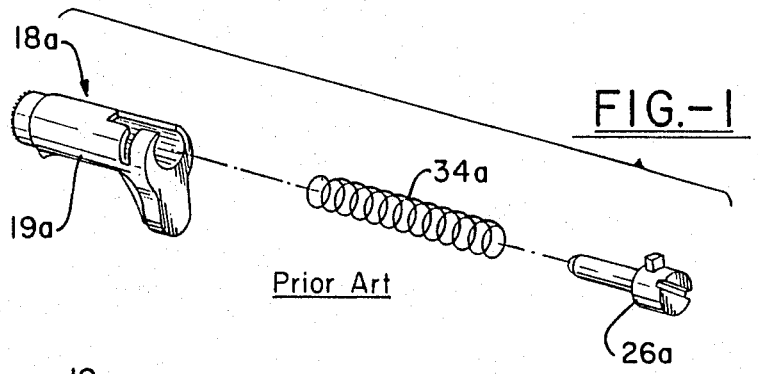
FIG.-1 Prior Art
FIG. 1 is an exploded view of a prior type of catch lock release.

Reference now is directed to the details of the accompanying drawings wherein portions only of a standard government model, "Colt 45" pistol are illustrated, specifically a partial vertical section of one such standard semi-automatic pistol is shown and is indicated as a whole by the numeral 10. A pistol grip portion 12 exists on this pistol 10 and the drawing shows an end of the magazine 14 which is removably carried in a recess or opening 15 provided in this pistol grip from the base or butt end thereof. A lock slot 16 of a conventional nature is provided in this magazine 14 and the invention relates to a magazine catch body 18, which is provided for retaining the magazine 14 in the pistol grip until release is desired for unloading ammunition therein or for normal reloading the magazine with live ammunition. This magazine catch body 18 primarily comprises a generally cylindrical body 19 which has one end protruding from the pistol grip 12 and which portion of the cylindrical body 18 is designated an actuate button 20 that extends from the left side of the pistol grip 12.

The present invention primarily relates to means provided at the right end of this magazine catch body for release by a person's right thumb or index finger to facilitate use of the gun in rapid fire, accurate shooting competitions.

Figure 3:
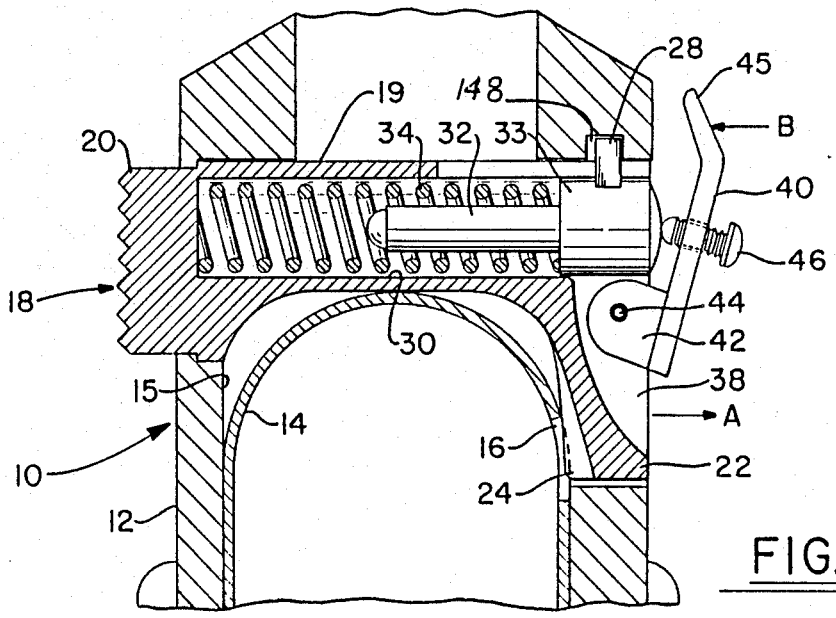
FIG. 3 is a fragmentary sectional view through a standard semi-automatic pistol showing the catch body and associated members of the present invention in the magazine locked position.
Figure 4:
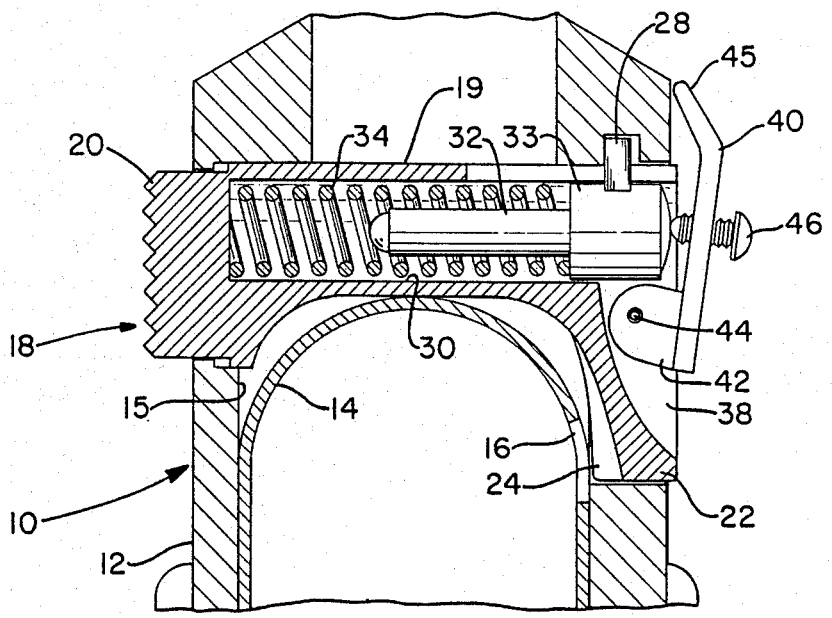
FIG. 4 is a fragmentary vertical section like FIG. 3 but with the catch body being in the magazine release position.

FIG. 3 of the drawings clearly shows that a control extension 22 is provided on this magazine catch body 18. Also a lock rib or flange 24 extends from the control extension and engages with the lock slot 16 formed in the magazine 14 for retaining the magazine fixedly in place in the pistol grip 12 until the magazine catch body 18 is moved to a release position, such as is indicated in FIG. 4.

FIG. 1 shows in exploded form the prior art of a magazine catch body structure, and particularly a magazine catch body **18*a* is shown. Such body 18*a* is adapted to receive the catch spring 34*a* therein which spring is retained in position by a catch lock release 26*a* that is adapted to be received in a bore in the magazine catch body, particularly in the cylindrical body 19*a* thereof and it is adapted to be operated from its lefthand end of the generally cylindrical body 19*a*** as shown in the drawing.

Figure 2:
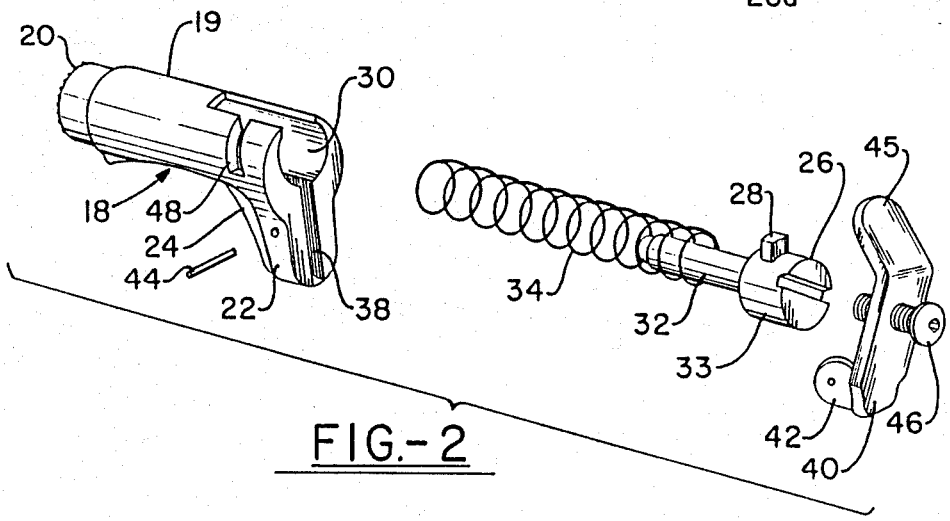
FIG. 2 is an exploded perspective view of the catch body and associated members of a release of the present invention showing the new operating and control parts of the structure of the invention.

In the present invention, only minor modifications are made to this magazine catch body structure of the prior art but the right hand operation of the magazine catch body 18 is now provided in an extremely convenient manner. Thus, in FIG. 2 there is shown catch lock release 26 that has a lock lug 28 provided thereon and which lock release is received in an eccentric bore 30 formed in the cylindrical body 19. The drawing shows that a cylindrical portion 32 is provided on one end of this lock release 26 and it telescopes into the opening of a catch spring 34 positioned in the bore 30. A head 33 is formed at the other end portion of this lock release 26 to facilitate control thereof from the right hand side of the gun butt if desired.

To provide a novel functioning and structure in this magazine catch body, a slot 38 starting at the lower margin of the bore 30 extends the length of this magazine control extension 22 and terminates adjacent the bottom or end of the control extension 22. Another added part to the magazine catch body release construction is a catch lock release lever 40 that has a lug 42 extending inwardly towards the gun structure at one end of this lever. Such lever 40 is formed from a flat metal member. The lug 42 extends into the slot 38 and a pin 44 is positioned in the control extension 22 to engage the lug 42 and operatively position this catch lock release lever 40. This lever 40 is positioned external of the gun, especially in the pistol grip portion 12 thereof.

The catch lock release lever 40 is shown in its operative position in FIG. 3 wherein one end 45 of the lever is spaced from the adjacent pistol grip and a force applying or transmitting pin or screw 46 is operatively engaged with the lever and bears on the head 33 of the lock release 26.

It will be noted that the lock release 26 is held against any axial movement when the lock lug 28 thereon is turned so as to engage with the slot 148 formed in the pistol grip 12. Such action can be obtained, of course, by properly axially positioning the lock release 26 in the eccentric bore 30 and rotating the lock release through a small arc, normally clockwise. At that time the lock release 26 will not move axially of the magazine catch body. When one applies any force on the free end of the catch lock release lever 40, it can be moved inwardly towards the pistol grip and at that time the force transmitting screw 46 functions as a fulcrum for the lever and it will cause the lower end of the catch lock release lever to move outwardly of the pistol grip as indicated by the arrow "A" in the drawings. Such action naturally immediately moves the lock rib or flange 24 out of engagement with the lock slot 16 and the magazine 14 is automatically expelled from the pistol grip 12, all by conventional means well known in the art.

It will be seen that the elements of the present structure differ from the prior art, are not complex, but yet a very simple release action is provided by the user's right index finger pushing the free end of the catch lock release lever 40 inwardly toward the pistol grip and indicated by the arrow "B". This provides a prompt and immediate release action for the magazine and the reloading operation for the magazine is greatly facilitated. The person shooting the pistol naturally would have his right index finger quite available on the pistol grip and it would be a very easily accomplished action to push this free end of the release lever 40 inwardly of the pistol grip for the desired magazine release with minimum time required for the release action.

From the foregoing it is believed that a novel and improved magazine catch body has been provided and which catch body has an ambidextrous release action and controls provided therefore. This structure is formed from conventional apparatus and members available in the art with a minimum of modification thereto. Yet improved results can be obtained in pistol shooting competition by use of the structure of the invention so that it is believed that the objects of the invention have been achieved.

While in accordance with the patent statutes, a preferred embodiment and best mode has been presented, the scope of the invention is not limited thereto, but rather is measured by the scope of the attached claims.

What is claimed is:

1. A magazine release for a semi automatic gun including:

a magazine catch body having a longitudinally extending opening, a catch lock release member slidably received in said longitudinally extending opening of said magazine catch body, resiliently compressably spring means held in said longitudinally extending opening resiliently compressed between said magazine catch body and said catch lock release member when said magazine catch lock body is inserted in and restrained in place in a hand grip of a gun receiver, said catch lock body having a control extension thereon with a lock flange extending from one side thereof, said lock flange being adapted to engage a lock slot in a magazine received in said gun receiver to retain the magazine therein, said magazine catch body normally being operatively positioned in and extending transversely through the hand grip, said control extension having a slot formed therein facing outwardly of the hand grip, a catch lock release lever having a lug thereon at its other end extending into said slot and being pivotally positioned therein to secure said catch lock release lever adjacent the side face of the hand grip, a fulcrum member engaging said catch release lever intermediate its ends to provide a free end on said catch lock release lever, said fulcrum member bearing on an outer end of said catch lock release member, and said catch lock release member being positionable to be restrained against axial movement whereby a force applied to the free end of said catch lock release lever to move it toward the hand grip will release said magazine.

2. An ambidextrous magazine release for use with a pistol having a hand grip comprising:

a catch body having a longitudinally extended opening formed therein;

a catch lock release member having a longitudinally extended body portion slidably received in said longitudinally extended opening in said catch body but retainable against movement relative to said catch body;

resiliently compressable spring means contained within said longitudinally extended opening resiliently urging said catch body and said catch lock release member apart;

a magazine catch release lever pivoted on said catch body at one end of such lever, said magazine catch lock release lever when operatively positioned being primarily positioned externally of and extending along the hand grip, the other end of said magazine catch lock release lever being normally positioned spaced from said hand grip, and a fulcrum member on said magazine catch lock release lever intermediate the ends thereof and bearing on said catch lock release member to move said catch body to release a retained magazine when said other end of said magazine catch lock release lever is moved toward said hand grip.

3. An ambidextrous magazine release as in claim 2 wherein said catch body has a control extension thereon at one end thereof, a slot is formed in said control extension, said magazine catch release lever having a lug thereon extending into said slot, and a member engages said lug to pivotally position said magazine catch release lever on said control extension.

4. An ambidextrous magazine release for positioning in an opening formed in a hand grip of a pistol to control a magazine in the hand grip and comprising:

a catch body having a longitudinally extended opening and being postionable in said first named opening formed therein;

a catch lock release member having a longitudinally extended body portion slidably received in said longitudinally extended opening in said catch body but retainable against movement relative to said hand grip;

a magazine catch release lever pivoted on said catch body at one end of such lever, said magazine catch lock release lever when operatively positioned, being primarily positioned externally of and extending along the hand grip; and a fulcrum member on said magazine catch lock release lever intermediate the ends thereof and bearing on said catch lock release member to move said catch body to release a retained magazine when said other end of said magazine catch lock release lever is moved toward said hand grip.

* * * * *